US006681411B1

(12) United States Patent
Wu et al.

(10) Patent No.: US 6,681,411 B1
(45) Date of Patent: Jan. 27, 2004

(54) BACTERIA REMOVING CLEANER

(76) Inventors: Tien-Yu Wu, 235 Chung-Ho Box 8-24, Taipei (TW); Sung-Seng Lu, 235 Chung-Ho Box 8-24, Taipei (TW); Li-Shang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/201,820

(22) Filed: Jul. 25, 2002

(51) Int. Cl.[7] ..... E03D 9/08
(52) U.S. Cl. ..... 4/420.4
(58) Field of Search ..... 4/420.4

(56) References Cited

U.S. PATENT DOCUMENTS 3,425,066 A * 2/1969 Berger ..... 4/420.4
5,452,483 A * 9/1995 Dizon, Jr. ..... 4/420.4
5,953,766 A * 9/1999 Szoke ..... 4/420.4
5,987,660 A * 11/1999 Wang ..... 4/420.4
6,006,372 A * 12/1999 Chang ..... 4/420.2

* cited by examiner

*Primary Examiner*—Charles E. Phillips

(57) ABSTRACT

A bacteria removing cleaner comprises a water-stopping control unit and a nozzle means. A plurality of conduits are used for transferring water. The water-stopping control unit has a rotary switch, a main body and a water-stop control valve for controlling the water inlet and water stopping. The main body is spaced into a water outlet space and a water inlet space. A water-stop control valve is installed at the interface of the water inlet space and the water outlet space. The top end of the water-stop control valve is connected to the rotary switch. The water-stop control valve is utilized to control water flow. By rotating a rotary switch, a washing time can be controlled effectively. Moreover, the bacteria removing cleaner is capable of being assembled to a stool rapidly and quickly. Thereby, the lifetime is prolonged.

2 Claims, 5 Drawing Sheets

BACTERIA REMOVING CLEANER

FIELD OF THE INVENTION

The present invention relates to cleaning device, and particularly to a bacteria removing cleaner. The washing time can be controlled effectively; moreover, the bacteria removing cleaner is capable of being assembled to a stool rapidly and quickly. Thereby, the lifetime is prolonged.

BACKGROUND OF THE INVENTION

In the prior art, the amount of flushing water is controlled by a computer device, but this design can not meet the requirement of everybody and thus it is inconvenient for many users. Moreover, the price and damage rate are high. Therefore, it can not be accepted by everybody.

In U.S. Pat. No. 6,006,372, "cleaner", assigned by the applicant of the present invention, disclosed a cleaner which has a main body 1 and a nozzle unit 2 and a plurality of conduits 3.

The main body 1 is formed by locking a control valve 11 and a lower receiving body 12. A control valve 11 has a control handle 13. Two lateral bottoms of the control handle 13 are formed with a large arc 131 and a small arc 132. A valve rod 14 is formed at an inner side. The valve rod 14 is enveloped by a compressing spring 141. An outer side thereof is enclosed by a valve cover 15. Moreover, the lower receiving body 12 is formed with an outer casing 121 and an inner wall 122. A plurality of pressure balance holes 123 are formed on the inner wall 122. Water inlet channels 16, 17 are installed at the proper positions of the casing 121. A retaining plate 18 is protruded from another side and the bottom thereof is installed with a water draining channel 19. The upper end of the water draining channel 19 has a valve cover 15. When the control handle 13 is pressed downwards so that the valve rod 14 and the valve cover 15 are pulled upwards, the water draining channel 19 can be opened for draining water. After the control handle 13 returns and the valve rod 14 is put down. Thereby, the valve cover 15 closes the water drain channel 19 so as to isolate the water from flowing through the water drain channel 19.

The nozzle unit 2 has a separable retaining pad 21. The retaining pad 21 may be an upper pad 211 or a lower pad 212 with the type of the stool by sticky or screw 213. Besides, the top end of the retaining pad 21 is installed with a nozzle conduit 22. One end of the nozzle conduit 22 is installed with a tube joint 23. Another end thereof is installed with a nozzle 24. The center of the nozzle 24 is installed with straight jetting holes 241, and the outer side of the straight jetting holes 241 has a plurality of inclined jetting holes 242. When water flows to the holes 241 and 242, the two kinds of water beams will interact so as to generate spiral water beams C so as to have preferred flushing effect. Referring to FIGS. 1 to 4 of the attachment, the user can press the large arc 131 or the small arc 132 (the water can be flushed continuously). When the control handle 13 is pressed and after the valve rod 14 and valve cover 15 are pulled upwards, clean water will enter, into the casing 121 from the water inlet channels 16 and 17. To prevent the valve cover 15 made of silicon rubber from being flushed by water, when water flows through the pressure balance holes in the inner wall 122 of the casing 121, the water will retain a constant water pressure. Then, the water flow is guided to the nozzle unit 2 through the water draining channel 19 (FIG. 6 of the attachment). When water flow to the holes 241 and 242, the two kinds of water beams will interact so as to generate spiral water beams C so as to have preferred flushing effect.

Furthermore, if it is to be closed. It is only necessary to return the handle 13 to the original position. By the ejecting force of the compressible spring 141, the valve rod 14 will resist a downward force. Meanwhile, the valve cover 15 will close the water draining channel 19. Therefore, water is isolated not to flow through the water draining channel (see (referring to FIGS. 1, 2 and 3).

In above clean structure, since the valve rod 14 is axially connected to the control handle 13 and the valve rod 14 passes through the valve cover 11. Thereby, the valve rod 14 below the valve cover 111 must be installed with a compressible spring 141, and then the valve cover 15 encloses the outer side of the valve rod. Since the valve cover 15 is made of silicone rubber, when the control handle 13 is pressed and after the valve rod 14 and valve cover 15 are pulled upwards, clean water will enter into the casing 121 from the water inlet channels 16 and 17. Then, the water flow is guided to the nozzle unit 2 through the water draining channel 19. When water flows to the holes 241 and 242, the two kinds, of water beams will interact so as to generate spiral water beams C so a;s to have preferred flushing effect. Furthermore, if it is to be closed. It is only necessary to return the handle 13 to original position. By the ejecting force of the compressible spring 141, the valve rod 14 will resist a downward force. Meanwhile, the valve cover. 15 will close the water draining channel 19. However, if it is used repeatedly, the valve rod 14 below the valve cover 111 will not close the water draining channel effectively so that water flows into the nozzle unit 2 continuously. Finally, water is drained out from the holes 241 and 242. Thereby, it can not achieve the object of the present invention.

Especially, when one water inlet channel 17 is used to transfer hot water. The valve cover 15 made of silicon rubber will be hardened so that the valve cover 15 can not close the water draining channel 19 effectively. As a result water flows into the nozzle unit 2 continuously from the water draining channel 19. Thus, water drains out from the nozzle holes 241 and 242.

SUMMARY OF THE INVENTION

Accordingly, the primary object of the present invention is to provide a bacteria removing cleaner which comprises a water-stopping control unit and a nozzle means. A plurality of conduits are used for transferring water. The water-stopping control unit has a rotary switch, a main body and a water-stop control valve for controlling the water inlet and water stopping. The main body is spaced into a water outlet space and a water inlet space. A water-stop control valve is installed at the interface of the water inlet space and the water outlet space. The top end of the water-stop control valve is connected to the rotary switch. The water-stop control valve is utilized to control water flow. By rotating a rotary switch, a washing time can be controlled effectively; moreover, the bacteria removing cleaner is capable of being assembled to a stool rapidly and quickly. Thereby, the lifetime is prolonged.

The various objects and advantages of the present invention will be more readily understood from the following detailed description when read in conjunction with the appended drawing.

DETAILED DESCRIPTION OF THE PREFERRED EMBODIMENTS

Figure 1:
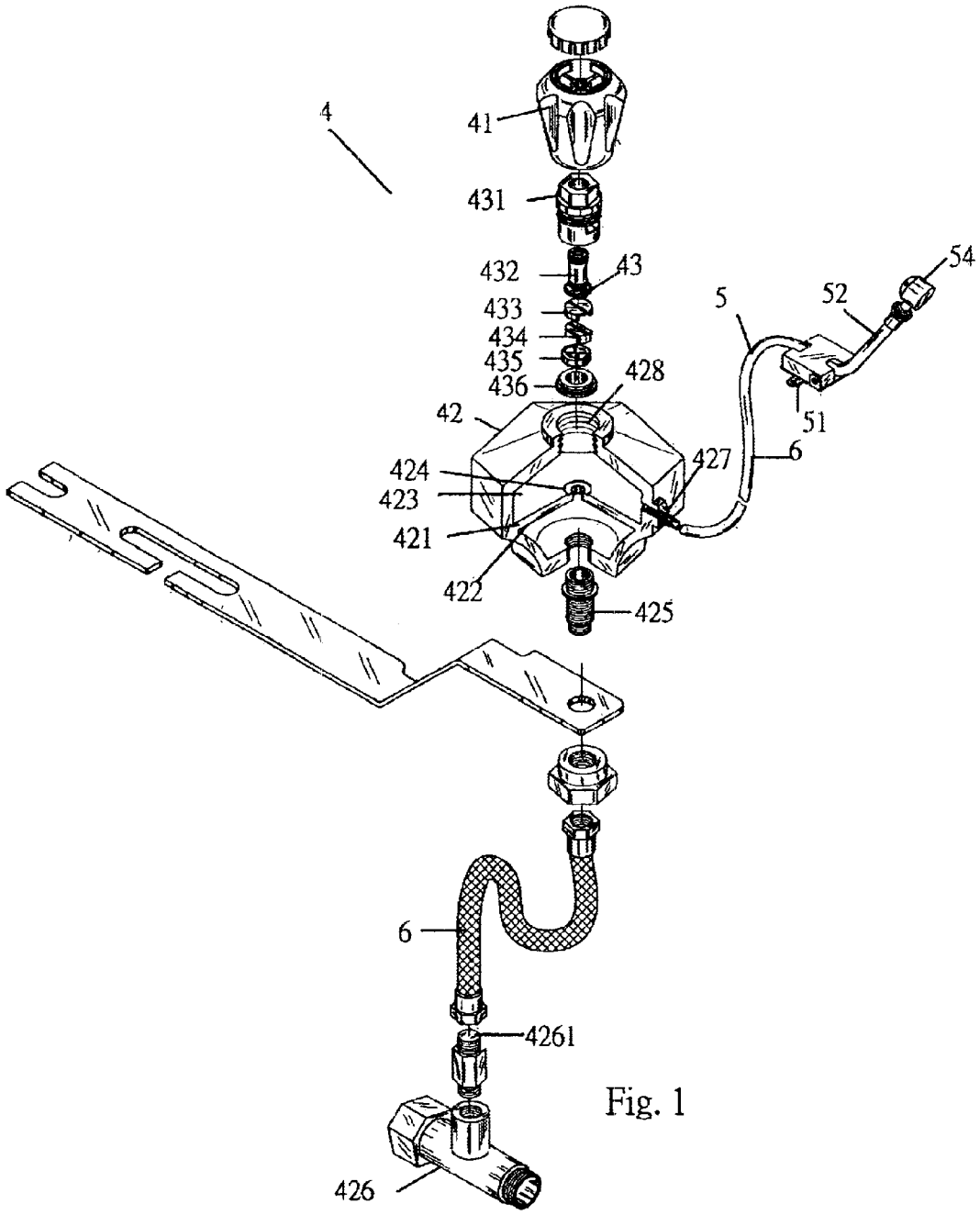
FIG. 1 is an exploded perspective view of the present invention.
Figure 2:
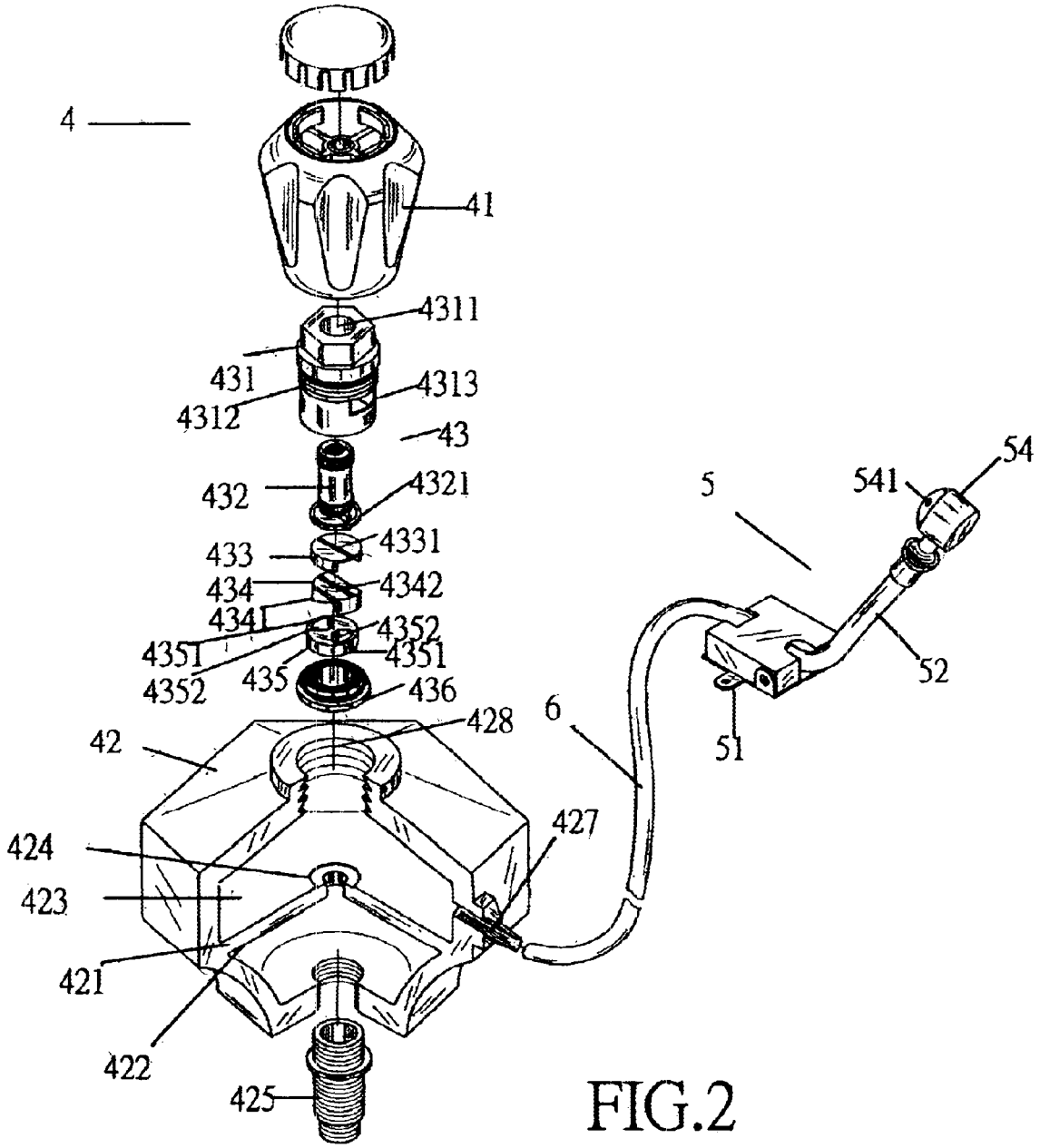
FIG. 2 is another exploded perspective view of the present invention.
Figure 3:
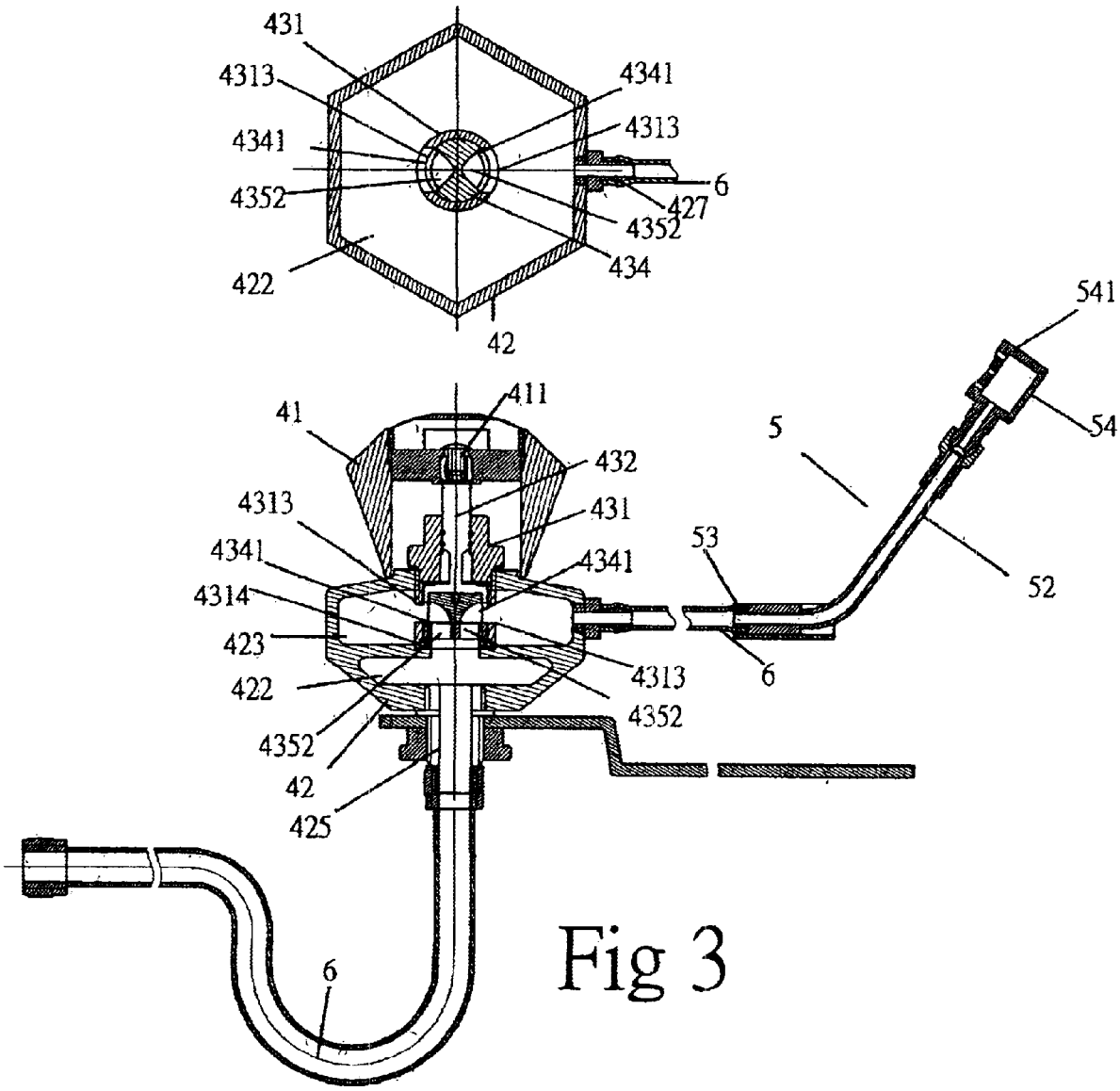
FIG. 3 is a cross section view illustrating the operation of the present invention.
Figure 4:
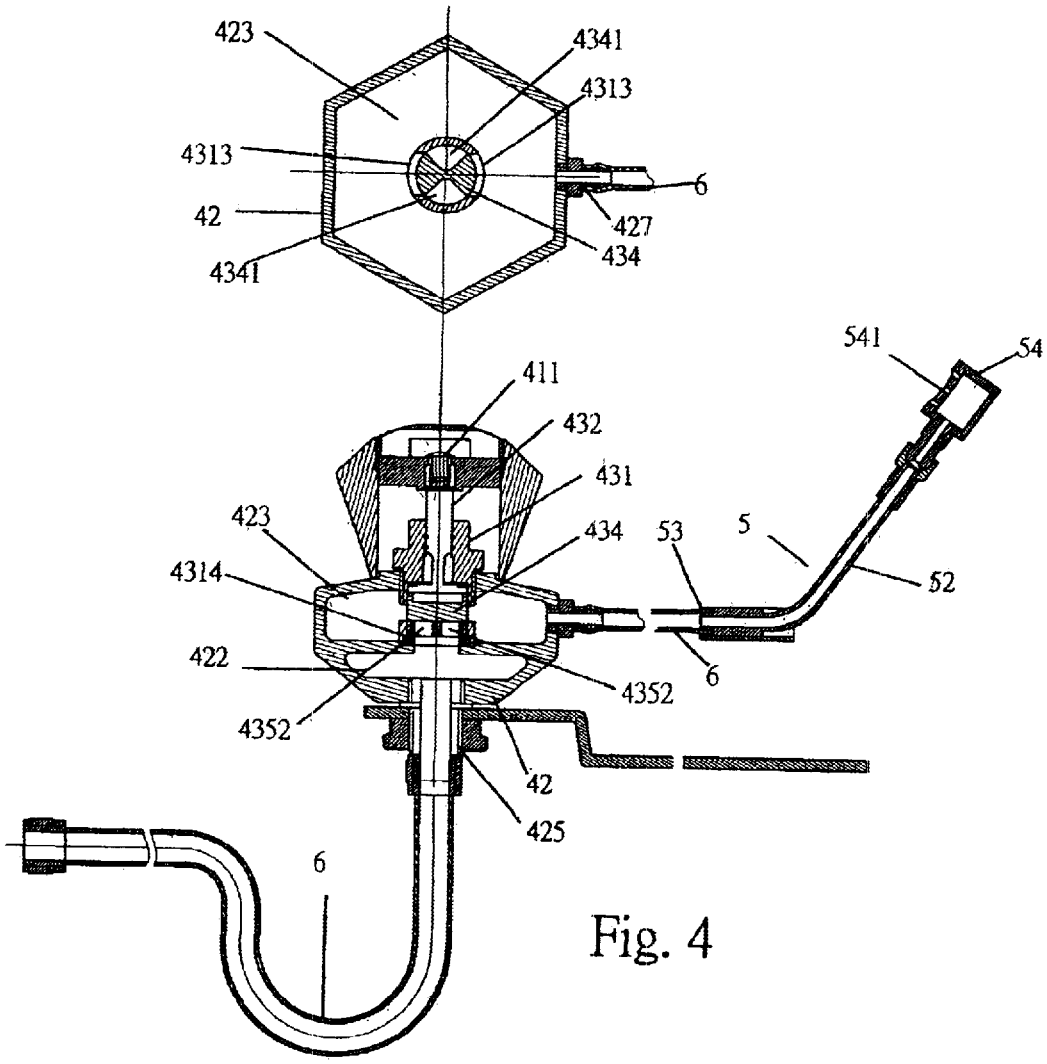
FIG. 4 is a cross section view showing another application of the present invention.

Referring to FIGS. 1, 2, 3 and 4, the structure of the present invention has a water-stopping control unit 4 and a nozzle means 5. A conduit 6 are used for transferring water. The nozzle means 5 has a separable retaining pad 51 which is fixed by adhering or screwing. A top of the retaining pad 51 is installed with a nozzle conduit 52 and lower end thereof has a joint 53. The nozzle conduit 52 has a top having a nozzle 54. The central portion and outer side of the nozzle 54 have a plurality of jetting holes 541.

The main feature of the present invention is that the water-stopping control unit 4 has a rotary switch 41, a main body 42 and a water-stop control valve 43 for controlling the water inlet and water stopping.

The interior of the main body 42 is spaced into a water inlet space 422 and a water outlet space 423 by a plurality of spacers 421. The center of the each spacer 421 has a fish eye hole 424. A bottom of the water inlet space 422 is rotatably connected to a water inlet joint 426 which can be connected to a stool water inlet switch (not shown) through the conduit 6 and a T joint 426. One side of the water outlet space 423 is pivotally connected with a water outlet joint 427 for being connected to the water tube joint 53 at the bottom of the retaining pad 51 through the conduit 6 and the nozzle means 5. A top center of the water outlet space 423 has a screw hole 428. The water-stop control valve 43 is inserted into the main body 42 from a central top thereof.

A center of the water-stop control valve 43 has a through hole 4311 and an interior of the lower section thereof is hollowed. The top periphery of the water-stop control valve 43 has thread 4312 which is engagable with the threaded hole 428 at a top center of the main body 42. Two sides of the water-stop control valve 43 have water outlet holes 4313. The interior of the lower section of the water-stop control valve 43 has a water outlet seat 431 with a positioning groove 4314. A rotary control stud 432 passes through the central through hole 4322 of the water outlet seat 431 and near the lower side of the rotary control stud 432 has a positioning block 4321.

A positioning means 433 has a through hole 4331 at one top surface thereof. The, positioning block 4321 at the lower end of the rotary water outlet seat 432 can pass through the through hole 4331.

An ceramic valve piece 434 has two sides each having a water outlet groove 4341, the upper side of the valve piece 434 is engaged with positioning means 433. The top surface of the ceramic valve. 434 has a positioning groove 4342. Bye rotating the positioning block 4321 at the lower end of the water outlet seat 432, the positioning block 4321 can be inserted into the positioning groove 4342.

A lower ceramic valve piece 435 has a top surface which is engagable with a bottom of the upper ceramic valve piece. Two peripheral sides of the lower ceramic valve piece 435 has positioning blocks 4351 for being coupled to the positioning grooves 4314 of the water outlet seat 431. A lower side of the lower ceramic valve piece 435 has water outlet hole 4352.

A coupling seat 436 is installed to a lower end of the water outlet seat 431.

Thereby, the lower end of the water-stop control valve 43 can be engaged to the fish eye holes 424 at a center of the spacers 421 in the main body 42. The rotary switch 41 is installed to a top of the main body 42. Then, the stud 411 is firmly secured to the top of the rotary adjusting stud 432 of the water-stop control valve 43 from the top end thereof.

When the present invention is operated, the operator can directly control the structure 4. The rotary switch 41 at a top of the main body 42 is rotated. Thus, the rotary switch 41 will drive the rotary control stud 432 of the water-stop control valve 43. Then the upper ceramic valve piece 434 of the rotary control stud 432 rotates through an angle so that the water outlet hole 4352 of the lower ceramic valve piece 435 tightly adhered to the upper ceramic valve piece 434 will align to the water outlet grooves 4341 at two sides of the upper ceramic valve piece 4341 Thus water flows through groove 4341 so as to flow to the nozzle means 5 (referring to FIG. 3). Then water flows to the nozzle holes 541 of the nozzle 54 for flushing objects.

If it is desired to close the present invention, the rotary switch 41 is rotates so as to drive the rotary control stud 42 at the top end of the main body 42. Then the upper ceramic valve piece 434, will rotate through an angle so that the water outlet hole 4352 of the lower ceramic valve piece 435 tightly adhered to the upper ceramic valve piece 434 will not align to the water outlet grooves 4341 at two sides of the upper ceramic valve piece 434. As a result water flows through the water outlet groove 4341 will be isolated (referring to FIG. 4)

Thereby, the prior art defect that the valve cover 15 can not close the water conduit 19 (referring to U.S. Pat. No. 6,006,372) so that water flow to the nozzle holes 242, 241 continuously and thus the water drains out.

Figure 5:
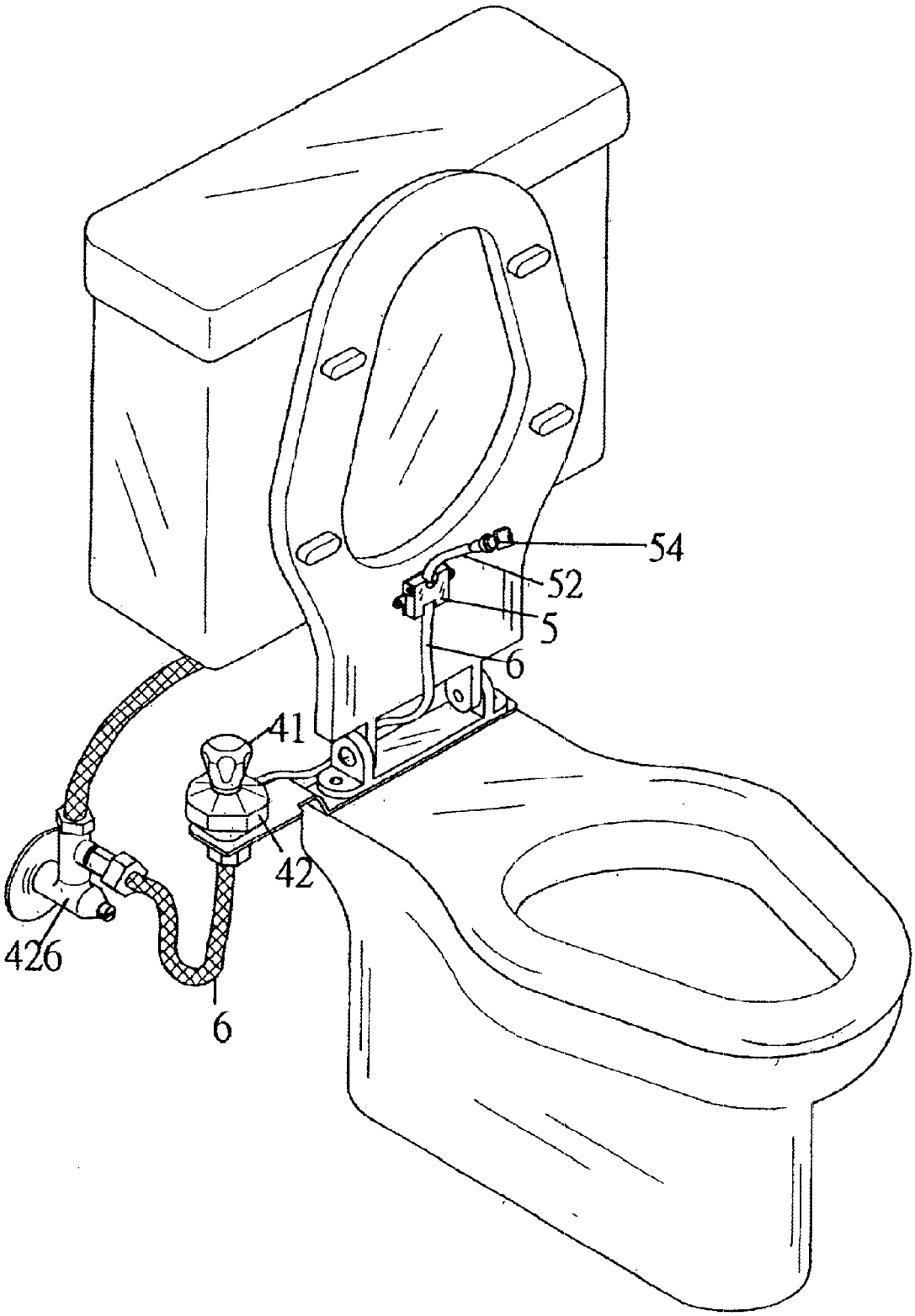
FIG. 5 is a perspective view showing one application of the present invention.

Referring to FIGS. 1 and 5, the water inlet space 422 at the lower end of the main body 42 is pivotally installed with a water joint 425. The joint 425 is connected to a T valve 426 of a stool through the conduit 6. A check valve can be installed at the water outlet end 4261 of the T valve 426 so that water will not return.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A bacteria removing cleaner comprising a water-stopping control unit and a nozzle means; wherein a conduit is used for transferring water; the nozzle means has a separable retaining pad which is fixed by adhering or screwing; a top of the retaining pad is installed with a nozzle conduit and lower end thereof has a water tube joint; the nozzle conduit has a top having a nozzle; a central portion and an outer side of the nozzle have a plurality of straight jetting holes; characterized in that: the water-stopping control unit has a rotary knob, a main body and a water-stop control valve for controlling the water inlet and water stopping;

an interior of the main body is spaced into a water inlet space and a water outlet space by a plurality of spacers; a center of the each spacer has a fish eye hole; a bottom of the water inlet space is rotatably connected to a water inlet joint which can be connected to a stool water inlet switch through the conduit and a T joint; one side of the water outlet space is pivotally connected with a water outlet joint for being connected to the water tube joint at a bottom of the retaining pad through the conduit and the nozzle means; a top center of the water outlet space has a screw hole; the water-stop control valve is inserted into the main body from a central top thereof;

the rotary knob is located above the water-stop control valve for turning the water-stop control valve;

a center of the water-stop control valve has a first through hole and an interior of a lower section of the water-stop control valve is hollowed; a top periphery of the water-stop control valve has threads which are engagable with the threaded hole at a top center of the main body; two sides of the water-stop control valve have water outlet holes; an interior of a lower section of the water-stop control valve has a water outlet seat with a positioning groove; a positioning block is located near the lower side of the water-stop control valve; a rotary control stud passes through a first through hole in a center portion of the water outlet seat;

a positioning means has a second through hole at one top surface thereof; the positioning block at the lower end of the rotary water outlet seat can pass through the second through hole;

an upper ceramic valve piece has two, sides each having a water outlet groove; an upper side of the upper ceramic valve piece is engaged with positioning means; a top surface of the ceramic valve has a positioning groove; by rotating the positioning block at the lower end of the water outlet seat, the positioning block is inserted into the positioning groove;

a lower ceramic valve piece has a top surface which is engagable with a bottom of the upper ceramic valve piece; two peripheral sides of the lower ceramic valve piece has positioning blocks for being coupled to the positioning grooves of the water outlet seat; a lower side of the lower ceramic valve piece has water outlet hole; and an coupling seat is installed to a lower end of the water outlet seat;

whereby the water-stop control valve is utilized to control water flow; by rotating the rotary switch, a washing time can be controlled effectively; moreover, the bacteria removing cleaner is capable of being assembled to a stool rapidly and quickly.

2. The bacteria removing cleaner as claim in claim 1, wherein the water inlet joint pivotally connected to a lower end of the water inlet space of the main body is connected to a T joint of a stool; and an water outlet end of the T joint of the stool connected to the water inlet joint is installed with a check valve.

* * * * *